US008246394B2

(12) United States Patent
Ono et al.

(10) Patent No.: US 8,246,394 B2
(45) Date of Patent: Aug. 21, 2012

(54) TERMINAL CONNECTOR WITH A CRIMPING PORTION WITH RECESSES

(75) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP); Kenji Okamura, Yokkaichi (JP); Masaaki Tabata, Yokkaichi (JP)

(73) Assignees: Sumitomo Wiring Systems, Ltd., Mie (JP); Autonetworks Technologies, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 18 days.

(21) Appl. No.: 12/867,965

(22) PCT Filed: Jun. 10, 2009

(86) PCT No.: PCT/JP2009/060592

§ 371 (c)(1),
(2), (4) Date: Aug. 17, 2010

(87) PCT Pub. No.: WO2009/154108

PCT Pub. Date: Dec. 23, 2009

(65) Prior Publication Data

US 2011/0009014 A1 Jan. 13, 2011

(30) Foreign Application Priority Data

Jun. 18, 2008 (JP) ..... 2008-159716

(51) Int. Cl.
*H01R 1/10* (2006.01)

(52) U.S. Cl. ..... 439/877

(58) Field of Classification Search ..... 439/877–882; 174/84 C, 74 R, 94 R
See application file for complete search history.

(56) References Cited

U.S. PATENT DOCUMENTS

| | | | | |
|---|---|---|---|---|
| 5,316,506 | A | 5/1994 | Ito | |
| 5,370,560 | A | 12/1994 | Ito | |
| 5,951,308 | A * | 9/1999 | Rea | 439/125 |
| 6,056,605 | A | 5/2000 | Nguyen et al. | |
| 7,070,465 | B2 * | 7/2006 | Masaki et al. | 439/850 |
| 2010/0297894 | A1 * | 11/2010 | Ootsuka et al. | 439/877 |

(Continued)

FOREIGN PATENT DOCUMENTS

JP U 51-80683 12/1976

(Continued)

OTHER PUBLICATIONS

International Search Report issued in corresponding International Application No. PCT/JP2009/060592, mailed Jul. 7, 2009. (with English-language translation).

(Continued)

*Primary Examiner* — Chandrika Prasad
(74) *Attorney, Agent, or Firm* — Oliff & Berridge, PLC

(57) ABSTRACT

A plurality of recesses are formed on a surface of a wire barrel where an electric wire is provided. In a state before the electric wire is crimped onto the wire, barrel, at least one of sides comprising rims of an opening of each recess of a quadrangular shape is a crossing side crossing at an angle of from 85 degrees to 95 degrees to an extending direction. In a state before the electric wire is crimped onto the wire barrel 16, the crossing sides of a plurality of recesses positioned adjacent to each other in the extending direction are so arranged as to overlap with each other in the extending direction.

13 Claims, 6 Drawing Sheets

U.S. PATENT DOCUMENTS

2011/0003518 A1* 1/2011 Ono et al. ..... 439/877

FOREIGN PATENT DOCUMENTS

| | | |
|---|---|---|
| JP | A 5-152011 | 6/1993 |
| JP | A 10-125362 | 5/1998 |
| JP | A 11-515137 | 12/1999 |
| JP | A 2000-335346 | 12/2000 |
| JP | A 2005-327690 | 11/2005 |

OTHER PUBLICATIONS

Written Opinion of the International Searching Authority issued in corresponding International Application No. PCT/JP2009/060592, mailed Jul. 7, 2009. (with English-language translation).

Notification of Reasons for Refusal issued in Japanese Patent Application No. 2008-159716; mailed Apr. 19, 2012; with English-language translation.

* cited by examiner

TERMINAL CONNECTOR WITH A CRIMPING PORTION WITH RECESSES

TECHNICAL FIELD

The present invention relates to a terminal connector and an electric wire with a terminal connector.

BACKGROUND ART

Conventionally, a terminal connector that is connected to an end of an electric wire disclosed in Patent Document 1 is known as an example of such a kind. The terminal connector comprises a crimping portion that is to be crimped onto a conductor exposed from an end of a covered electric wire so as to surround the conductor.

An oxide layer is formed on a surface of the conductor, and the oxide layer is interposed between the conductor and the crimping portion. This may increase a contact resistance between the conductor and the crimping portion.

In the prior art, recesses (serrations) are formed on an inner side (a side closer to the conductor) of the crimping portion. The recesses continuously extend in a direction crossing to an extending direction of the conductor in a state in that the crimping portion is crimped onto the conductor. A plurality of recesses are aligned along the extending direction of the conductor.

When the crimping portion is crimped onto the conductor of the electric wire, the conductor is pressed against the crimping portion so as to be plastically deformed in the extending direction of the conductor. Then, the oxide layer formed on the surface of the conductor rubs against opening edges of the recesses and removed therefrom. Then, the surface of the conductor emerges and comes in contact with the crimping portion. This reduces a contact resistance between the conductor and the terminal connector.

[Patent Document 1] Japanese Unexamined Patent Publication No. JP-10-125362

DISCLOSURE OF THE INVENTION

However, if a metal on which the oxide layer is comparatively easily formed, for example, aluminum or other materials is used for the conductor, the oxide layer may not be removed sufficiently even if the recesses are formed on the crimping portion. This may not sufficiently reduce a contact resistance between the conductor and the crimping portion.

If a cycle of heating and cooling (cooling and heating cycle) is repeated in a state in that the crimping portion is crimped onto the electric wire, the conductor and the crimping portion are expanded and shrunk repeatedly. This causes a gap between the conductor and the crimping portion, and accordingly, a contact resistance may be reduced.

It may be considered that a compression rate of the crimping portion is decreased (high compression). Accordingly, the oxide layer formed on the conductor is sufficiently removed therefrom, and it is expected that the contact resistance between the conductor and the crimping portion is reduced. Further, the opening edges of the recesses bite into the conductor, and therefore, it is expected that generation of the gap between the conductor and the crimping portion is suppressed even if the cooling and heating cycle is repeated.

However, if the compression rate of the crimping portion is decreased (high compression), mechanical strength, especially tensile strength (specifically, strength that the terminal connector holds the electric wire) is reduced, because a reduction rate of a cross-sectional area of the conductor is high.

Therefore, there is a need in the art to provide a terminal connector and an electric wire with a terminal connector that reduces a contact resistance and improves a cooling and heating ability and increases a holding force of a conductor by a crimping portion.

SUMMARY

The present invention provides the terminal connector comprising a crimping portion that is crimped onto a conductor exposed at an end of an electric wire so as to surround the exposed conductor. A plurality of recesses are formed on a surface of the crimping portion where the electric wire is provided, and the recesses are arranged with a distance therebetween in an extending direction in which the electric wire that is crimped onto the crimping portion extends, and in a state before the crimping portion is crimped onto the electric wire, the recesses are formed to be arranged in a crossing direction crossing to the extending direction with a distance therebetween. In a state before the crimping portion is crimped onto the electric wire, rims of an opening of each recess form a square shape and at least one of sides comprising the rims of the opening of each recess is a crossing side that crosses at an angle ranging from 85 degrees to 95 degrees to the extending direction. In a state before the crimping portion is crimped onto the electric wire, a length of the crossing side is set to be or greater than a distance between the crossing sides of the recesses that are arranged adjacent to each other in the crossing direction, and the crossing sides of the recesses that are arranged adjacent to each other in the extending direction are arranged to overlap with each other in the extending direction.

The present invention provides the electric wire with a terminal connector comprising an electric wire having a conductor and the terminal connector that is crimped onto an end of the electric wire.

According to the present invention, an edge formed on the rims of the opening of each recess removes an oxide layer that is formed on a surface of a conductor and the surface of the conductor emerges. The electric wire and the terminal connector are electrically connected to each other by the contact of the emerging surface and the crimping portion.

Since a plurality of recesses are formed, a total length of the rims of the opening of the recesses is increased. This increases a total length of edges formed on the rims of the opening of the recesses. This also increases a total area of the conductor which the edges formed on the rims of the opening of the recesses bite into. This improves cooling and heating ability.

The crossing side of the rims of the opening of the recesses crosses at the angle ranging from 85 degrees to 95 degrees to the extending direction of the electric wire. If a force in the extending direction of the electric wire is applied to the electric wire that is crimped onto the crimping portion, the edges formed on the crossing sides bite into the conductor. This increases holding force of the crimping portion for holding the conductor.

Further, the crossing sides of a plurality of recesses that are arranged adjacent to each other in the extending direction are arranged to overlap with each other in the extending direction. Therefore, there is surely an area of the conductor which the edge formed on the crossing side bites into in the extending direction of the electric wire. This further increases the holding force of the crimping portion for holding the conductor.

DESCRIPTION OF THE REFERENCE NUMERALS

10 ELECTRIC WIRE WITH A TERMINAL CONNECTOR
11 ELECTRIC WIRE
12 FEMALE TERMINAL CONNECTOR (TERMINAL CONNECTOR)
13 CORE WIRE (CONDUCTOR)
16 WIRE BARREL (CRIMPING PORTION)
17 CONNECTING PORTION
18 RECESS
19A FIRST CROSSING SIDE (CROSSING SIDE 19)
19B SECOND CROSSING SIDE (CROSSING SIDE 19)
22 CROSSING INCLINED SURFACE

BEST MODES FOR CARRYING OUT THE INVENTION

Figure 1:
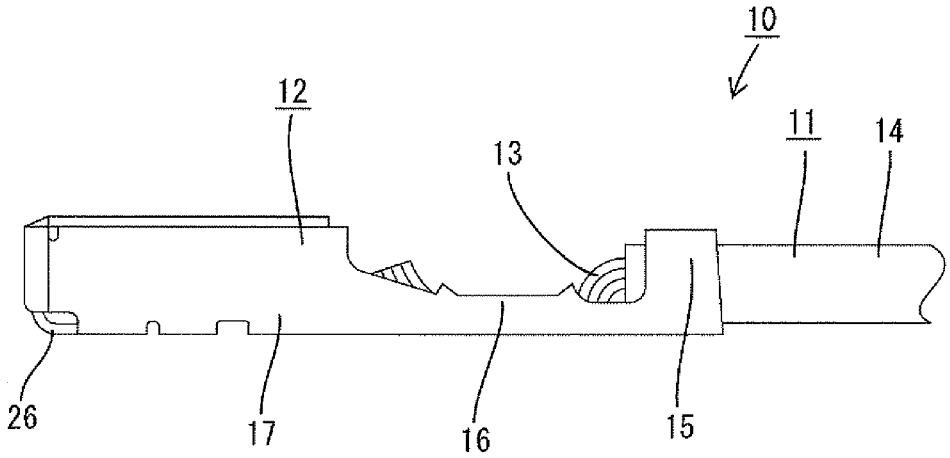
FIG. 1 is a side view illustrating an electric wire with a terminal connector according to the present embodiment.

One embodiment of the present invention will be explained with reference to FIG. 1 through FIG. 6. As illustrated in FIG. 1, the present embodiment provides an electric wire with a terminal connector 10 wherein a female terminal connector (corresponding to a terminal connector of the present invention) 12 is crimped onto a core wire (corresponding to a conductor of the present invention) 13 that is exposed from an end of an electric wire 11.

(Electric Wire 11)

As illustrated in FIG. 1, the electric wire 11 comprises the core wire 13 and wire insulation 14. The core wire 13 is a stranded wire including a plurality of metal thin wires. The wire insulation 14 is made of an insulating synthetic resin and formed so as to surround an outer periphery of the core wire 13. Any metal suitable for intended application such as copper, copper alloy, aluminum, aluminum alloy or other metals can be used for the metal thin wire. In the present embodiment, aluminum alloy is used for the core wire 13. As illustrated in FIG. 1, the wire insulation 14 is removed at the end of the electric wire 11 so as to expose the core wire 13.

(Female Terminal Connector 12)

Figure 3:
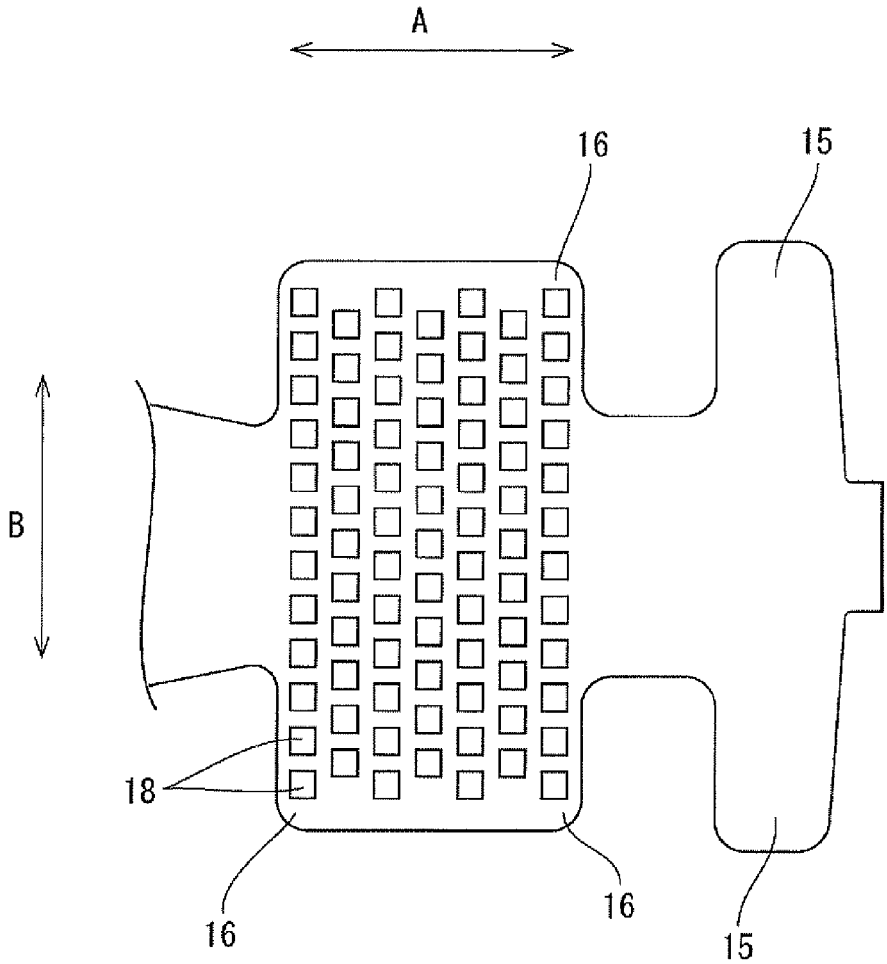
FIG. 3 is an enlarged plan view illustrating a main portion of the female terminal connector in an exploded state.

A metal plate material is pressed into a predetermined shape with a die (not shown) to form the female terminal connector 12. The female terminal connector 12 comprises an insulation barrel 15, a wire barrel 16 (corresponding to the crimping portion of the present invention) and a connecting portion 17. The insulation barrel 15 is crimped to surround an outer periphery of the wire insulation 14 of the electric wire 11. The wire barrel 16 is continuously formed from the insulation barrel 15 and crimped so as to surround the core wire 13. The connecting portion 17 is continuously formed from the wire barrel 16 and connected to a male terminal connector (not shown). As illustrated in FIG. 3, the insulation barrel 15 is formed to have two plate portions each of which extends in an upper direction and a lower direction.

Figure 2:
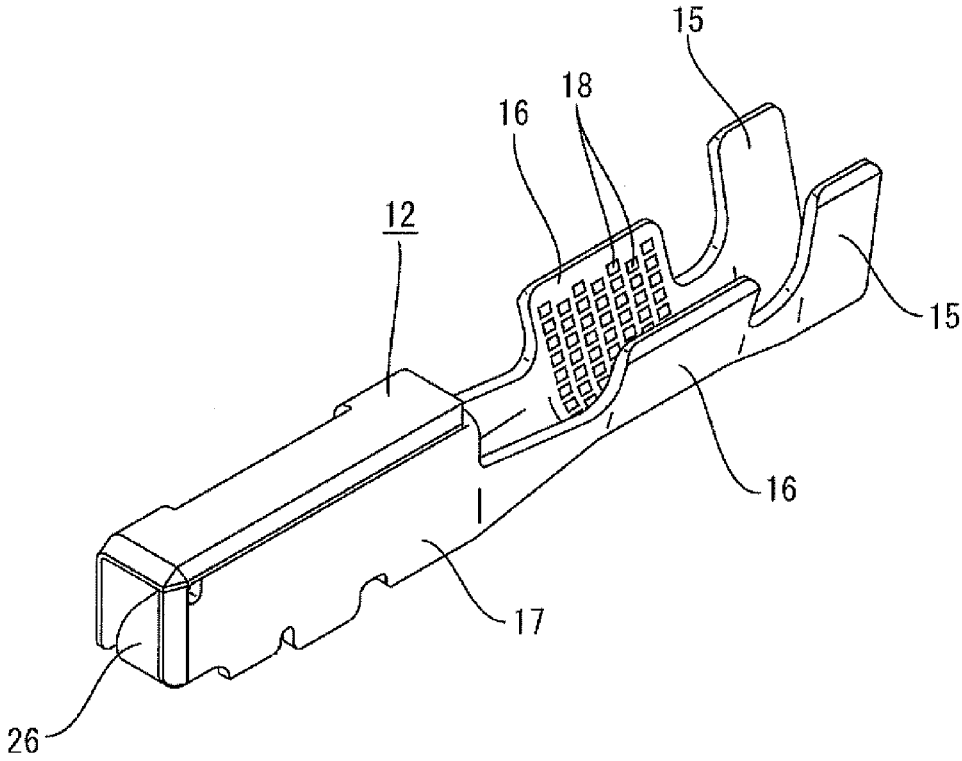
FIG. 2 is a perspective view illustrating a female terminal connector.

As illustrated in FIG. 2, the connecting portion 17 is formed in a tubular shape so as to receive a male tab (not shown) of the male terminal connector. An elastic contact portion 26 is formed in the connecting portion 17. The elastic contact portion 26 is elastically contacted to the male tab of the male terminal connector so as to electrically connect the male terminal connector and the female terminal connector 12.

In the present embodiment, the female terminal connector 12 is formed in a tubular shape and has the connecting portion 17. However, it is not limited thereto and for example, the male terminal connector having the male tab or an LA terminal that is formed by forming a penetration hole in a metal plate material may be provided instead of the female terminal connector 12. The terminal connector may be formed in any shape suitable for intended application.

(Wire Barrel 16)

FIG. 3 shows an enlarged plan view of a main portion of the wire barrel 16 in its exploded state (in a state before being crimped onto the electric wire). As illustrated in FIG. 3, the wire barrel 16 is formed to have two plate portions each of which extends in an upper direction and a lower direction in FIG. 3. Before being crimped onto the electric wire, the wire barrel 16 is formed in a substantially rectangular shape seen from a direction penetrating through a paper of FIG. 3.

As illustrated in FIG. 3, a plurality of recesses 18 are formed in a surface of the wire barrel 16 where the electric wire is provided at the time of crimping of the electric wire (a surface at a front side in a direction penetrating through the paper of FIG. 3). Rims of an opening of each recess 18 form a quadrangular shape seen from the direction penetrating through the paper of FIG. 3 before crimping of the electric wire. Specifically, in the present embodiment, the rims of the opening of each recess 18 form a rectangular shape.

As illustrated in FIG. 3, the recesses 18 are arranged in an extending direction of the core wire 13 in a state in that the wire barrel 16 is crimped onto the core wire 13 (a direction shown by an arrow A in FIG. 3) with a distance therebetween.

Further, as illustrated in FIG. 3, the recesses 18 are arranged in a crossing direction (a direction shown by an arrow B in FIG. 3) crossing to the extending direction of the core wire 13 (a direction shown by an arrow A in FIG. 3) with a distance therebetween. In the present embodiment, the crossing direction crosses to the extending direction at a right angle. The crossing direction crosses to the extending direction at any angle suitable for intended application.

Figure 4:
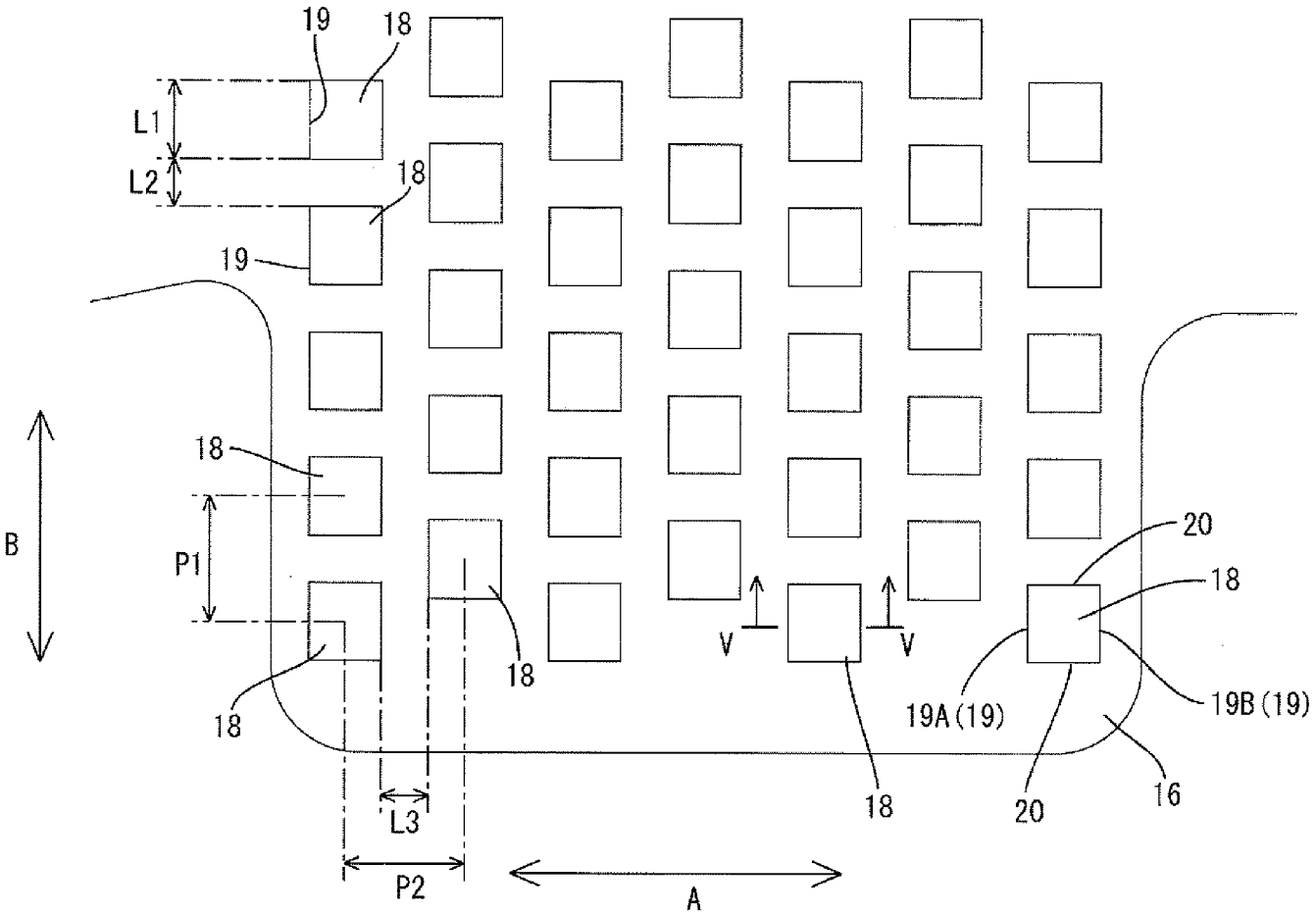
FIG. 4 is an enlarged plan view illustrating a main portion of recesses formed in a wire barrel.

The rims of the opening of each recess 18 may be comprised of two crossing sides 19 crossing at an angle ranging from 85 degrees to 90 degrees to the extending direction of the core wire 13 (the direction shown by the arrow A in FIG. 3). In the present embodiment, as illustrated in FIG. 4, each crossing side 19 crosses at substantially 90 degrees to the extending direction. The crossing side 19 is comprised of a first crossing side 19A and a second crossing side 19B. The first crossing side 19A is located closer to an end side of the electric wire 11 (left side in FIG. 4) and the second crossing side 19B is located at an opposite side from the end side of the electric wire 11 (right side in FIG. 4). In FIG. 4, description of an inner structure of the recess 18 is omitted.

The rims of the opening of each recess 18 comprise two connecting sides 20 each of which connects each crossing side 19A and each crossing side 19B. Each of the connecting sides 20 is inclined by an angle ranging from −10 degrees to +10 degrees with respect to the extending direction of the core wire 13 (the direction shown by the arrow A in FIG. 4).

As illustrated in FIG. 4, a length L1 of each crossing side 19 is set to be equal to or greater than a distance L2 between the crossing sides 19 of the recesses 18 that are positioned adjacent to each other in the crossing direction (the direction shown by the arrow B in FIG. 4). Accordingly, the crossing sides of a plurality of recesses that are positioned adjacent to each other in the extending direction (the direction shown by the arrow A in FIG. 4) are so arranged as to overlap with each other in the extending direction. Specifically, in a plurality of recesses 18, the crossing sides 19 of one recess 18 overlap with the crossing sides 19, 19 of another plurality of recesses 18, 18 (two recesses in the present embodiment) in the extending direction. The another recesses 18, 18 are positioned adjacent to the one recess 18 in the extending direction and are aligned along the crossing direction.

A pitch distance P1 between the adjacent recesses 18 in the crossing direction (the direction shown by the arrow B in FIG. 4) crossing to the extending direction of the core wire 13 (the direction shown by the arrow A in FIG. 4) is set to be within the range from 0.1 mm to 0.8 mm. In the present embodiment, P1 is set to be 0.5 mm. The pitch distance P1 is a distance in the crossing direction between an intersection point of the diagonal lines of one recess 18 and an intersection point of the diagonal lines of another recess 18 that is located next to the one recess 18.

The distance between the recesses 18 that are positioned adjacent to each other in the crossing direction (the direction shown by the arrow B in FIG. 4) is set to be L2 in the present embodiment. The distance L2 is set to be 0.1 mm or more and to be a half or less of the pitch distance P1 between the recesses in the crossing direction (the direction shown by the arrow B in FIG. 4). In the present embodiment, the distance L2 is set to be 0.1 mm.

As illustrated in FIG. 4, a pitch distance P2 between the recesses 18 in the extending direction (the direction shown by the arrow A in FIG. 4) is set to be within the range from 0.3 mm to 0.8 mm. In the present embodiment, P2 is set to be 0.4 mm. The pitch distance P2 is a distance in the extending direction between an intersection point of the diagonal lines of one recess 18 and an intersection point of the diagonal lines of another recess 18 that is located next to the one recess 18.

A distance L3 between the recesses 18 that are positioned adjacent to each other in the extending direction (the direction shown by the arrow A in FIG. 4) is 0.1 mm or more and the distance L3 is set to be a value or less that is obtained by subtracting 0.1 mm from the pitch distance P2 between the recesses 18 that are positioned adjacent to each other in the extending direction. In the present embodiment, L3 is set to be 0.2 mm.

Figure 5:
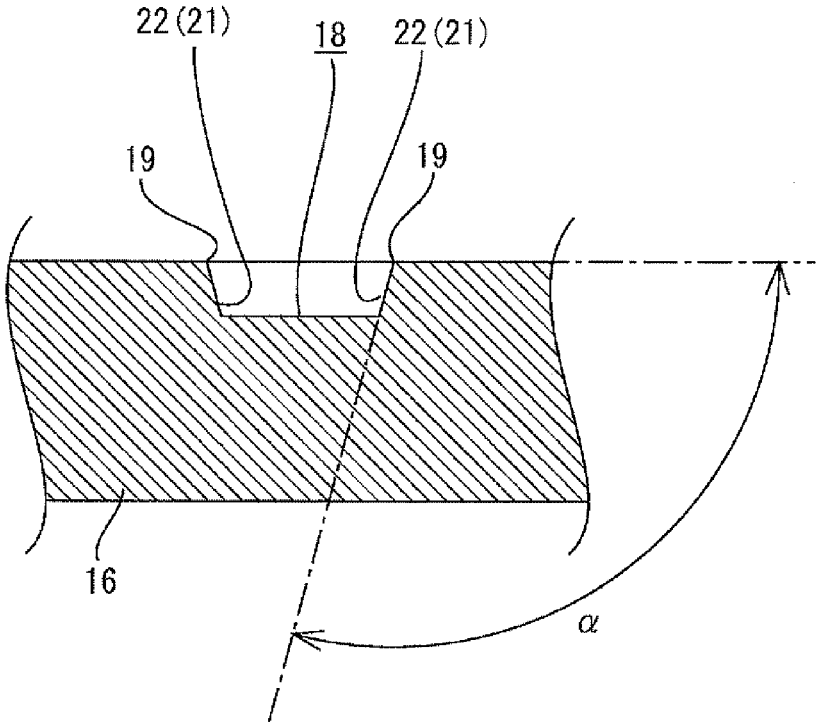
FIG. 5 is a cross-sectional view of FIG. 4 taken along a V-V line.

As illustrated in FIG. 5, a bottom surface of the recess 18 is formed so as to be smaller than a whole size of the opening rims of the recess 18. Accordingly, the bottom surface of the recess 18 is connected to the opening rims of the recess 18 by four inclined surfaces 21 that are inclined to spread from the bottom surface of the recess 18 toward the opening rims of the recess 18. Two inclined surfaces 21 are described in FIG. 5.

As illustrated in FIG. 5, the inclined surfaces 21 each of which connects each of the two crossing sides 19 and the bottom surface of the recess 18 are referred to as crossing inclined surfaces 22. An angle $\alpha$ formed by the crossing inclined surface 22 and a surface of the wire barrel 16 where the core wire 13 is provided is set to satisfy a condition that the angle $\alpha$ is within the range from 90 degrees to 110 degrees. In the present embodiment, the angle $\alpha$ is set to be 105 degrees.

In the present embodiment, the compression rate of the core wire 13 that is crimped onto the wire barrel 16 is expressed by a percent of the cross-sectional area of the core wire 13 after crimping onto the wire barrel 16 with respect to the cross-sectional area of the core wire 13 before being crimped onto the wire barrel 16. Specifically, the compression rate is set to be within the range from 40% to 70%. In the present embodiment, the compression rate is set to be 60%.

Next, operations and effects of the present embodiment will be explained. The following shows one example of a process for attaching the female terminal connector 12 to the electrical wire 11. First, a metal plate material is formed in a predetermined shape by press molding with a die. At this time, the recesses 18 may be formed simultaneously.

Thereafter, the metal plate material that is formed in the predetermined shape is processed to be bent to form the connecting portion 17 (see FIG. 2). At this time, the recesses 18 may be formed.

As is not specifically illustrated in the drawings, a plurality of protruding parts are formed in the die for press molding of the female terminal connector 12 at the positions corresponding to the recesses 18 of the wire barrel 16.

As illustrated in FIG. 4, the recesses 18 formed in the wire barrel 16 are aligned along the direction (the direction shown by the arrow B) crossing to the extending direction of the core wire 13 with a distance therebetween.

Subsequently, the wire insulation 14 of the electric wire 11 is removed to expose the core wire 13. In a state in that the core wire 13 is positioned on the wire barrel 16 and the wire insulation 14 is positioned on the insulation barrel 15, the barrels 15, 16 are crimped onto the electric wire 11.

Figure 6:
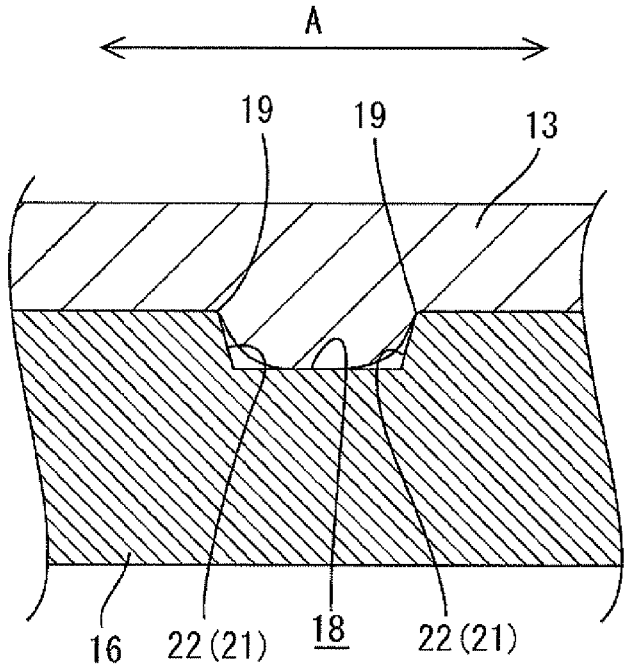
FIG. 6 is an enlarged sectional view illustrating a main portion of a core wire and a wire barrel in a state in that the wire barrel is crimped onto the core wire.

When the wire barrel 16 is crimped onto the core wire 13, the core wire 13 is pressed by the wire barrel 16 to be plastically deformed and extended in the extending direction of the core wire 13 (the direction shown by the arrow A in FIG. 6) as illustrated in FIG. 6. Then, the outer peripheral surface of the core wire 13 rubs against the edges of the opening rims of each recess 18. Accordingly, the oxide layer formed on the outer peripheral surface of the core wire 13 is removed and the surface of the core wire 13 emerges. The core wire 13 and the wire barrel 16 are electrically connected to each other by the contact of the emerging surface and the wire barrel 16. In FIG. 6, the cross-section of a plurality of core wire 13 is schematically illustrated as a whole.

Since a plurality of recesses 18 are formed, a total length of the opening rims of the recesses 18 is increased. This increases a total length of the edges formed on the opening rims of the recesses 18. This also increases a total area of the core wire 13 which the edges formed on the opening rims of the recesses 18 bite into. This suppresses generation of a gap between the core wire 13 and the wire barrel 16 even if the cooling and heating cycle is repeated. Accordingly, the cooling and heating ability is improved.

The crossing sides 19 comprising the opening rims of the recess 18 cross to the extending direction of the electric wire at an angle of substantially 90 degrees. Accordingly, when a force in the extending direction of the electric wire 11 is applied to the electric wire 11 that is crimped onto the wire barrel 16, the edges formed on the crossing sides 19 bite into the core wire 13. This increases a holding force of the wire barrel 16 for holding the core wire 13.

Further, the crossing sides 19 of a plurality of recesses that are arranged adjacent to each other in the extending direction are arranged so as to overlap with each other in the extending direction. Therefore, there is surely an area of the core wire 13 which the edge formed on the crossing side 19 bites into in the extending direction of the electric wire 11. This further increases a holding force of the wire barrel 16 for holding the core wire 13.

According to the present embodiment, the crossing side 19 comprises the first crossing side 19A and the second crossing side 19B. The first crossing side 19A is one of the sides forming the opening rims of the recess 18 that is located closer to the end side of the electric wire 11. The second crossing side 19B is one of the sides forming the opening rims of the recess 18 that is located closer to an opposite side of the end side of the electric wire 11. When a force is applied to the electric wire 11 in a direction toward the end side, the core wire is surely held by the first crossing side 19A. When a force is applied to the electric wire 11 in a direction toward the opposite side of the end side, the core wire is surely held by the second crossing side 19B.

According to the present embodiment, a plurality of recesses 18 are aligned along the crossing direction with a relatively small pitch distance P1 that is from 0.1 mm to 0.8 mm. This increases the number of recesses 18 in a unit area. This also increases a total area occupied by the edges formed on the opening rims of the recesses 18 in the unit area. Accordingly, a total area of the core wire 13 which the edges formed on the opening rims of the recesses 18 bite into is relatively increased. This increases the holding force of the wire barrel 16 for holding the core wire 13.

If the distance between the recesses 18 is excessively small, an excessive load is applied to the die in press working of a metal plate material for forming the female terminal connector 12 with the die. Therefore, it is not preferable. According to the present embodiment, the distance L2 between the recesses 18 that are arranged adjacent to each other in the crossing direction is set to be 0.1 mm or more. It is suppressed that an excessive load is applied to the die for molding the recesses 18.

The distance L2 between the recesses 18 that are arranged adjacent to each other in the crossing direction is set to be a half or less of the pitch distance P1 between the recesses 18 in the crossing direction. Accordingly, one of the recesses 18 and other recess 18 that is arranged adjacent to the one recess 18 in the extending direction are arranged so as to overlap with each other in the extending direction.

According to the present embodiment, the recesses 18 are aligned along the extending direction with a relatively small pitch distance P2 that is from 0.3 mm to 0.8 mm. This increases the number of the recesses 18 in a unit area. This also increases a total area occupied by the edges formed on the opening rims of the recesses 18 in the unit area. Accordingly, a total area of the core wire 13 which the edges formed on the opening rims of the recesses 18 bite into in the unit area is relatively increased. This increases the holding force of the wire barrel 16 for holding the core wire 13.

If the distance between the recesses 18 is excessively small, an excessive load is applied to the die in press working of a metal plate material for forming the terminal connector with the die. Therefore, it is not preferable. On the other hand, if a width of the recess 18 in the extending direction is excessively small, a width of the protruding part of the die for forming the recess 18 is also excessively small. This applies an excessive force to the die and this is not preferable.

According to the present embodiment, the distance L3 between the recesses 18 that are arranged adjacent to each other in the extending direction is set to be 0.1 mm or more. This suppresses an excessive load from being applied to the die in press working. Further, the distance L3 between the recesses 18 that are arranged adjacent to each other in the extending direction is set to be the value or less that is obtained by subtracting 0.1 mm from the pitch distance P2 between the recesses 18 in the extending direction. This suppresses an excessive load from being applied to the die for molding the recesses 18.

The crossing inclined surface 22 connecting the crossing side 19 of the recess 18 and the bottom surface of the recess 18 is formed to have an angle $\alpha$ of 105 degrees with respect to the surface of the wire barrel 16 where the core wire 13 is arranged. As is described before, the recesses 18 are formed by compressing the protruding parts formed in the die to the metal plate material. The inclined surfaces 21 that are inclined to spread from the bottom surface of the recess 18 toward the opening rims of the recess 18 are formed between the opening rims of the recess 18 and the bottom surface of the recess 18 so as to easily separate the protruding parts of the die from the metal plate material after pressing. In other words, an obtuse angle is formed by the inclined surface 21 and the surface of the wire barrel 16 where the core wire 13 is arranged.

The angle $\alpha$ formed by the inclined surface 21 and the surface of the wire barrel 16 where the core wire 13 is provided is great. This means that the opening rim of the recess 18 has a gentle edge. In the present embodiment, the angle $\alpha$ formed by the crossing inclined surface 22 and the surface of the wire barrel 16 where the core wire 13 is provided is 105 degrees, which is a relatively small obtuse angle. Therefore, the crossing side 19 of the recess 18 has a relatively steep edge. Therefore, the edges formed on the crossing sides 19 bite into the core wire 13 to surely remove the oxide layer formed on the core wire 13.

In the present embodiment, the core wire 13 is formed of aluminum alloy. If the core wire 13 is formed of aluminum alloy, the oxide layer is relatively easy to be formed on the surface of the core wire 13. The present embodiment is effective in the case in that the oxide layer is formed on the surface of the core wire 13.

The wire barrel 16 is required to be crimped onto the core wire 13 with a low compression rate (high compression) to remove the oxide layer formed on the surface of the core wire 13 and reduce the contact resistance. According to the present embodiment, the wire barrel 16 is crimped onto the electric wire 11 with a relatively low compression rate (high compression) that is from 40% to 70%. Therefore, the oxide layer formed on the surface of the core wire 13 is effectively removed. The compression rate is preferably from 40% to 60%, and more preferably from 40% to 50% if the cross-sectional area of the conductor of the electric wire 11 is large.

According to the present embodiment, a relatively great stress is applied to the core wire 13 corresponding to the areas of the wire barrel 16 between the recesses 18. Accordingly, the oxide layer formed on the surface of the core wire 13 is exactly removed by the opening rims of each recess 18 such that the surface of the core wire 13 emerges.

Other Embodiments

The present invention is not limited to the aspects explained in the above description made with reference to the drawings. The following aspects may be included in the technical scope of the present invention, for example.

(1) In the above embodiment, the opening rims of each recess 18 comprise the first crossing side 19A and the second crossing side 19B. However, the opening rims of each recess 18 may comprise one crossing side 19. The crossing side 19 may be provided only on the opening rim closer to the end side of the electric wire 11 or only on the opening rim closer to the opposite side from the end side of the electric wire 11.

(2) In the above embodiment, the opening rims of the recess 18 form a rectangular shape. However, the opening rims of the recess may form any quadrangular shapes suitable for intended application such as a quadrangle having no parallel sides, a trapezoidal shape, a parallelogram, a diamond shape and a square.

In a case in that the opening rims of the recess 18 form a parallelogram, each recess 18 may be aligned along the extending direction of the connecting sides 20 with a distance therebetween.

(3) The angle formed by the extending direction of the electric wire 11 and the connecting side 20 may not be limited to be in the range of −10 degrees to +10 degrees.

The invention claimed is:

1. A terminal connector comprising:

a crimping portion that is crimped onto a conductor exposed at an end of an electric wire so as to surround the exposed conductor, wherein a plurality of recesses are formed on a surface of the crimping portion where the electric wire is provided, and the recesses are arranged with a distance therebetween in an extending direction in which the electric wire that is crimped onto the crimping portion extends, and in a state before the crimping portion is crimped onto the electric wire, the recesses are formed to be arranged in a crossing direction crossing to the extending direction with a distance therebetween, wherein in a state before the crimping portion is crimped onto the electric wire, rims of an opening of each recess form a quadrangular shape and at least one of sides comprising the rims of the opening of each recess is a crossing side that crosses at an angle ranging from 85 degrees to 95 degrees to the extending direction, and wherein in a state before the crimping portion is crimped onto the electric wire, a length of the crossing side is set to be equal to or greater than a distance between the facing terminal ends of the crossing sides of the recesses that are arranged adjacent to each other in the crossing direction, and the crossing sides of the recesses that are arranged adjacent to each other in the extending direction are arranged to overlap with each other in the extending direction so that the crossing sides are present over the entire length of all of the plurality of recesses on the crimping portion in the crossing direction.

2. The terminal connector according to claim 1, wherein the crossing side is one of the sides comprising the rims of the opening of each recess, the one of the sides being positioned closer to an end side of the electric wire.

3. The terminal connector according to claim 1, wherein the crossing side is one of the sides comprising the rims of the opening of each recess, the one of the sides being positioned closer to an opposite side from the end side of the electric wire.

4. The terminal connector according to claim 1, wherein the crossing side is comprised of a first crossing side and a second crossing side, the first crossing side being positioned closer to an end side of the electric wire and the second crossing side being positioned closer to an opposite side from the end side of the electric wire.

5. The terminal connector according to claim 1, wherein in a state before the crimping portion is crimped onto the electric wire, a pitch distance between the recesses in the crossing direction is from 0.1 mm to 0.8 mm.

6. The terminal connector according to claim 5, wherein in a state before the crimping portion is crimped onto the electric wire, a distance between the recesses that are arranged adjacent to each other in the crossing direction is between 0.1 mm and half of the pitch distance between the recesses in the crossing direction.

7. The terminal connector according to claim 1, wherein in a state before the crimping portion is crimped onto the electric wire, a pitch distance between the recesses in the extending direction is from 0.3 mm to 0.8 mm.

8. The terminal connector according to claim 7, wherein in a state before the crimping portion is crimped onto the electric wire, a distance between the facing rims of the recesses that are arranged adjacent to each other in the extending direction is between 0.1 mm to a value of 0.1 mm less than the pitch distance between the recesses in the extending direction.

9. The terminal connector according to claim 1, wherein in a state before the crimping portion is crimped onto the electric wire, the rims of the opening of each recess are connected to a bottom surface of each recess by four inclined surfaces that spread from the bottom surface of each recess toward the rims of the opening of each recess, and an angle formed by a crossing inclined surface and a surface of the crimping portion where the electric wire is provided and no recess is formed is from 90 degrees to 110 degrees, the crossing inclined surface being one of the four inclined surfaces and connecting the crossing side and the bottom surface of each recess.

10. The terminal connector according to claim 1, wherein the crossing sides of one recess of the recesses overlap with the crossing sides of another plurality of recesses of the recesses in the extending direction, and the another recesses are positioned adjacent to the one recess in the extending direction and are aligned along the crossing direction.

11. An electric wire with a terminal connector comprising:

an electric wire having a conductor; and the terminal connector according to claim 1, the terminal connector being crimped onto an end of the electric wire.

12. The electric wire with a terminal connector according to claim 11, wherein the conductor is formed of aluminum or aluminum alloy.

13. The electric wire with a terminal connector according to claim 11, wherein when a compression rate of the conductor that is crimped onto the crimping portion is expressed by a percent of a cross-sectional area of the conductor after being crimped onto the crimping portion with respect to a cross-sectional area of the conductor before being crimped onto the crimping portion, the compression rate is from 40% to 70%.

* * * * *